US006558206B1

(12) United States Patent
Machida et al.

(10) Patent No.: US 6,558,206 B1
(45) Date of Patent: May 6, 2003

(54) ELECTRIC CONNECTOR

(75) Inventors: Yukifumi Machida, Tokyo (JP); Michiyasu Watanabe, Tokyo (JP); Yoshikazu Tanaka, Tokyo (JP); Ryo Sawada, Tokyo (JP)

(73) Assignee: Ryosei Electro-Circuit Systems, Ltd., Tokyo (JP)

( * ) Notice: Subject to any disclaimer, the term of this patent is extended or adjusted under 35 U.S.C. 154(b) by 0 days.

(21) Appl. No.: 09/868,064

(22) PCT Filed: Dec. 16, 1999

(86) PCT No.: PCT/JP99/07075

§ 371 (c)(1),
(2), (4) Date: Aug. 30, 2001

(87) PCT Pub. No.: WO00/38279

PCT Pub. Date: Jun. 29, 2000

(30) Foreign Application Priority Data

Dec. 18, 1998 (JP) ..... 10/360748
Dec. 18, 1998 (JP) ..... 10/360749

(51) Int. Cl.[7] ..... H01R 13/514; H01R 13/40
(52) U.S. Cl. ..... 439/752; 439/595
(58) Field of Search ..... 439/752, 489, 439/587, 598, 346

(56) References Cited

U.S. PATENT DOCUMENTS

| | | | | |
|---|---|---|---|---|
| 4,802,869 A | | 2/1989 | Maue | |
| 5,569,055 A | * | 10/1996 | Yamanashi et al. | 439/595 |
| 5,722,857 A | * | 3/1998 | Saito et al. | 439/595 |
| 5,777,480 A | * | 7/1998 | Hatagishi et al. | 324/538 |
| 5,897,402 A | | 4/1999 | Sasai et al. | |
| 6,139,375 A | * | 10/2000 | Konoya et al. | 439/752 |
| 6,149,462 A | * | 11/2000 | Sugie | 439/595 |

FOREIGN PATENT DOCUMENTS

| | | |
|---|---|---|
| JP | 7-85921 | 3/1995 |
| JP | 8-96879 | 4/1996 |
| JP | 11-238542 | 8/1999 |

OTHER PUBLICATIONS

Microfilm of the specification & drawings annexed to the request of Japanese Utility Model Appln. No. 189568/1987 Jun. 19, 1989 (Laid–open No. 92773/1989).

Microfilm of the specification & drawings annexed to the request Japanese Utility Model Appln. No. 77945/1984 Dec. 16, 1985 (Laid–open No. 189968/1985).

* cited by examiner

*Primary Examiner*—Lynn D. Feild
*Assistant Examiner*—Chandrika Prasad

(57) ABSTRACT

A rear holder 4 is inserted into a housing 3 from a rear end surface 24 at a provisional locking position in which the rear holder 4 is inserted into the housing 3 halfway and an insertion of connecting terminals is allowed, as well as at a sufficiently inserted complete locking position at which the inserted connecting terminals are locked. Within the housing 3, there are formed two rows of terminal accommodating holes 28 each accommodating respective connecting terminals. The rear holder 4 is formed in a substantially plate-like shape and includes a main body 41 which is inserted into slits 29 of the housing 3 and locking arms 45 which are inserted into respective terminal accommodating holes 28. A width of a locking arm 45 is slightly smaller than that of a terminal accommodating hole 28. Windows 37 are formed in the outer wall 21 of the housing 3 such that the terminal accommodating holes 28 are communicated with external through the windows 37. Through these windows 37, locking condition between the connecting terminals 2 and the locking arms 45 can be released and an electrical conduction test of the connecting terminals 2 can be performed.

4 Claims, 15 Drawing Sheets

ELECTRIC CONNECTOR

CROSS-REFERENCE TO RELATED APPLICATIONS

This application is a U.S. national phase application of International Application No. PCT/JP99/07075 filed Dec. 16, 1999, which application was not published in English.

BACKGROUND OF THE INVENTION (1) Field of the Invention

The present invention relates to an electrical connector, which may be used for a wire harness in automobiles, and more particularly relates to an electrical connector, in which connecting terminals contained in a housing are locked by a rear holder which is engaged with a rear portion of the housing.

(2) Description of Related Art

In conventional electrical connectors for use in a wire harness, connecting terminals installed within a housing are locked in position by means of flexible locking arms. In general, the locking arms are formed integrally with the housing. Therefore, the housing including the locking arms is liable to be complicated in construction, and a mold for manufacturing the housing becomes very complicated and expensive. Since each locking arms are formed within respective connecting terminal accommodating holes, a width of a locking arm has to be much smaller than a width of a connecting terminal accommodating hole and a sufficiently large locking force could not be attained.

In order to improve the difficulty in manufacturing the housing as well as to increase a size of the locking arms, there has been proposed to form locking arms in a separate rear holder as illustrated in FIGS. 1 and 2. In this known electrical connector, a rear holder c is inserted into an opening b formed in a housing a such that the rear holder is clamped at two positions with respect to the housing a by means of locking means not shown. A first position is a provisional locking position in which the rear holder c is halfway inserted into the housing a, and a second position is a complete locking position in which the rear holder c is completely inserted into the housing a.

At the provisional locking position, a connecting terminal e having an electric wires d connected thereto is inserted into a rectangular hollow portion f of the rear holder c such that a projection i of a locking arm h is engaged with an opening g formed in the connecting terminal e. When the rear holder c is further inserted into the housing up to the complete locking position, front ends j of the locking arms h ride over guide portions k of the housing a and a locking force of the locking arms h is increased.

However, in the known electrical connector, since the rear holder c includes the rectangular hollow portions f, a structure of a mold or tool for manufacturing the rear holder could not be simplified sufficiently. That is to say, the mold must be constructed to have one or more bushings and still has a complicated structure. When it is required to release a locking condition between a locking arm h and a connecting terminal e, a special tool has to be inserted into a rectangular hollow portion f from a rear end of the rear holder c, and thus the rear holder c and connecting terminal e might be injured by the tool.

Similarly, in the known electrical connector having the locking arms integrally formed with the housing, when it is required to remove a connecting terminal from the housing, a special tool has to be inserted into the housing from a rear end of the housing along an electric conductor or from a front end through an opening into which connecting terminals of a corresponding electrical connector have to be inserted, and the locking arm is resiliently bent by the tool to release a locking condition between the locking arm and the connecting terminal. Then, the electrical conductor is pulled to remove the connecting terminal from the housing.

Moreover, each of the above mentioned known electrical connectors is composed of a number conductors connected to a wire harness, connecting terminals and housing, and therefore in order to prevent an erroneous connection of wire harnesses, it is necessary to perform an electrical conduction test. Upon conducting the electrical conduction test, after all the connecting terminals have been inserted into the housing, an electrical conduction testing tool is inserted into the housing from the front side opening through which connecting terminals of a corresponding electrical connector are to be inserted into the housing, and the testing tool is engaged with the connecting terminals.

As explained above, in case of releasing a locking condition between a connecting terminal and a locking arm, since the releasing tool must be inserted into the housing from the front side opening of the housing, the inserting operation is liable to be difficult and the housing and connecting terminals might be damaged by the tool. Furthermore, upon performing the electrical conduction test, the testing tool must be inserted into the housing from the front side opening such that the tool is engaged with the connecting terminals, it is required to insert the testing tool with a relatively large force. Furthermore, if connecting terminals of a corresponding electrical connector have been inserted into the housing, it is necessary to remove them before conducting the electrical conduction test.

SUMMARY OF THE INVENTION

The present invention has for its object to provide an electrical connector which can mitigate the above mentioned drawbacks and locking arms can be manufactured easily.

It is another object of the invention to provide an electrical connector, in which a clamping force of a locking arm can be improved.

It is another object of the invention to provide an electrical connector, in which a locking condition between a connecting terminal and a locking arm can be easily released through a window formed in a housing.

It is still another object of the invention to provide an electrical connector, an electrical conduction test for a connecting terminal inserted into a housing can be performed easily by means of a window formed in the housing.

DETAILED DESCRIPTION OF THE INVENTION

Figure 1:
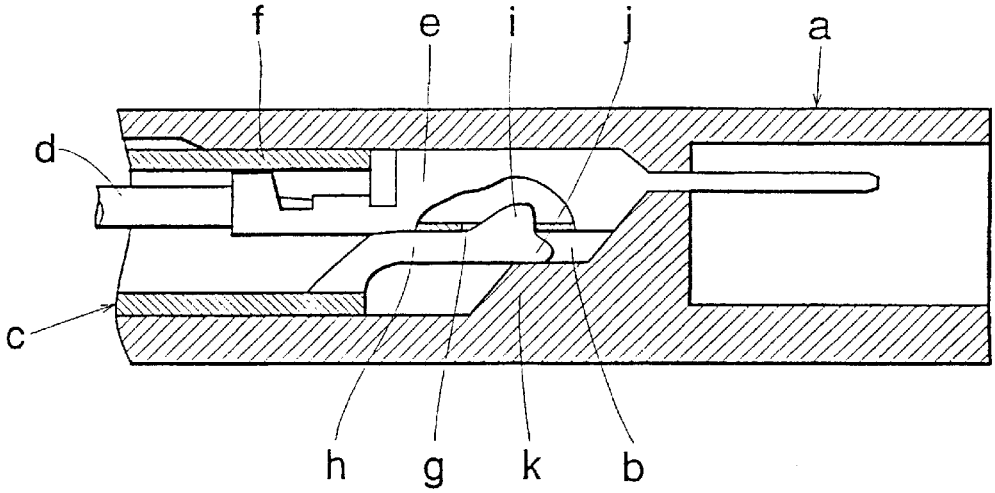
Fig.1 Prior Art
FIG. 1 is a longitudinal cross sectional view showing a part of a known electric connector.

According to the invention, an electrical connector including a housing containing one or more connecting terminals having electric cables connected thereto, a rear holder engaged with a rear portion of the housing such that the connecting terminals are held within the housing, and a locking means for locking said housing and rear holder with each other, characterized in that said rear holder is formed by a substantially plate-like member which comprises a main portion which is inserted into slits formed in the housing and is engaged with said locking means such that said main portion is engaged with the housing, and locking arms provided at a front end of said main portion and are inserted into respective connecting terminal accommodating holes formed in the housing such that the connecting terminals are locked.

According to another aspect of the invention, an electrical connector a housing containing one or more connecting terminals having electric cables connected thereto, a rear holder engaged with a rear portion of the housing such that the connecting terminals are held within the housing, and a locking means for locking said housing and rear holder with each other, characterized in that said rear holder comprises a main portion which is inserted into slits formed in the housing and is engaged with said housing by means of said locking means, and locking arms provided at a front end of said main portion and are inserted into respective connecting terminal accommodating holes formed in the housing such that the connecting terminals are locked, and that windows are formed in upper and lower walls of the housing at positions near locking portions between said connecting terminals and said locking arms such that said connecting terminal accommodating holes are communicated with external through said windows.

Now the present invention will be explained in detail with reference to embodiments shown in the drawings.

Figure 2:
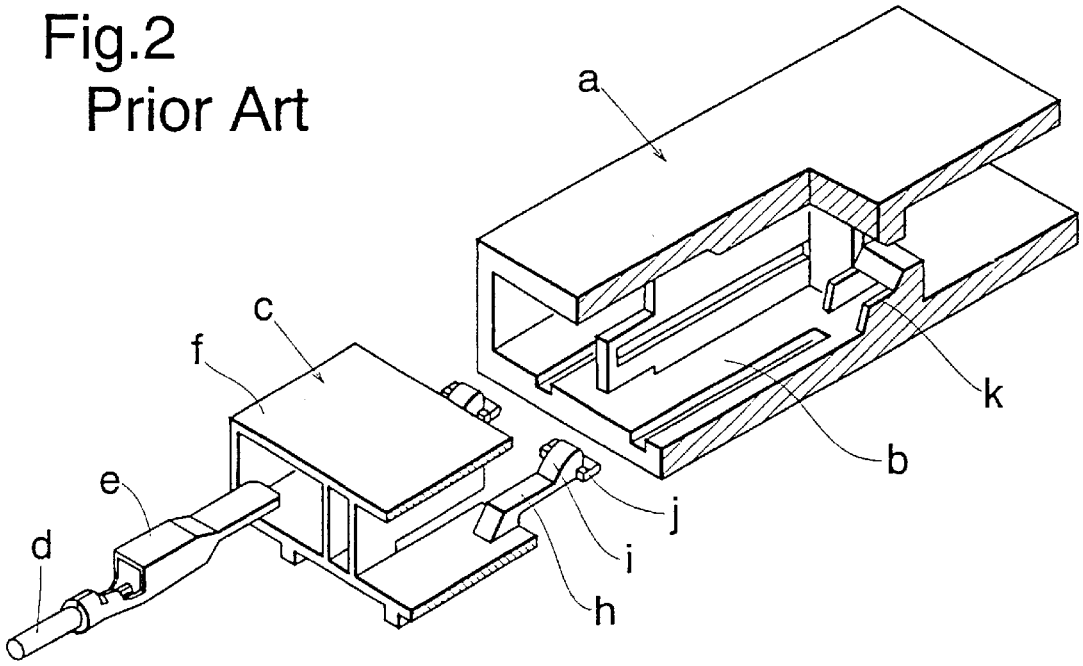
Fig.2 Prior Art
FIG. 2 is an exploded perspective view of the known connector, while a part of the electric connector is cut out.
Figure 3:
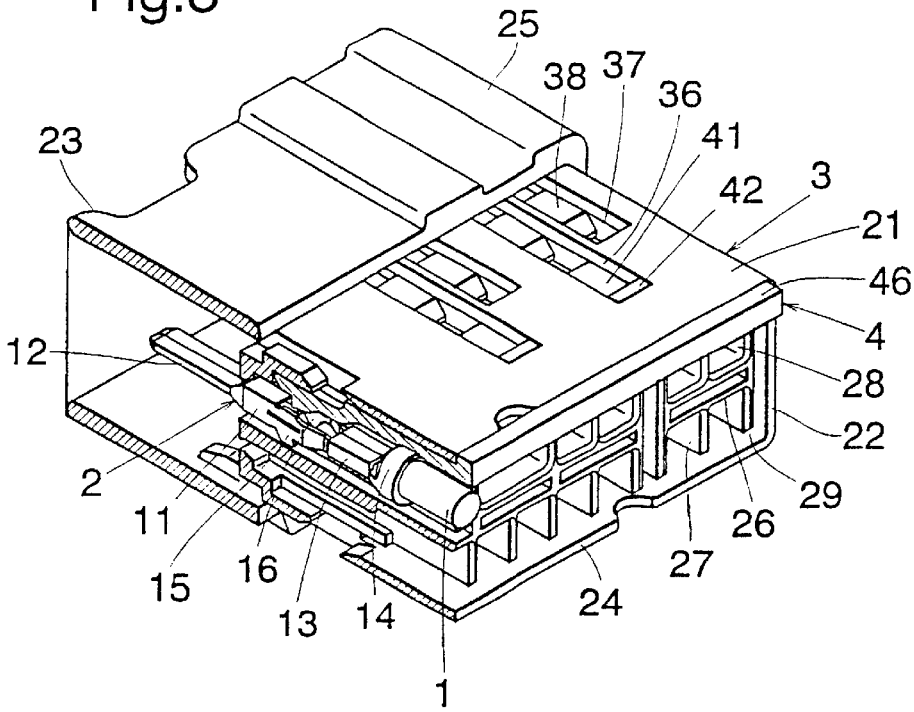
FIG. 3 is a perspective view illustrating a first embodiment of the electric connector according to the invention in the assembled condition.
Figure 4:
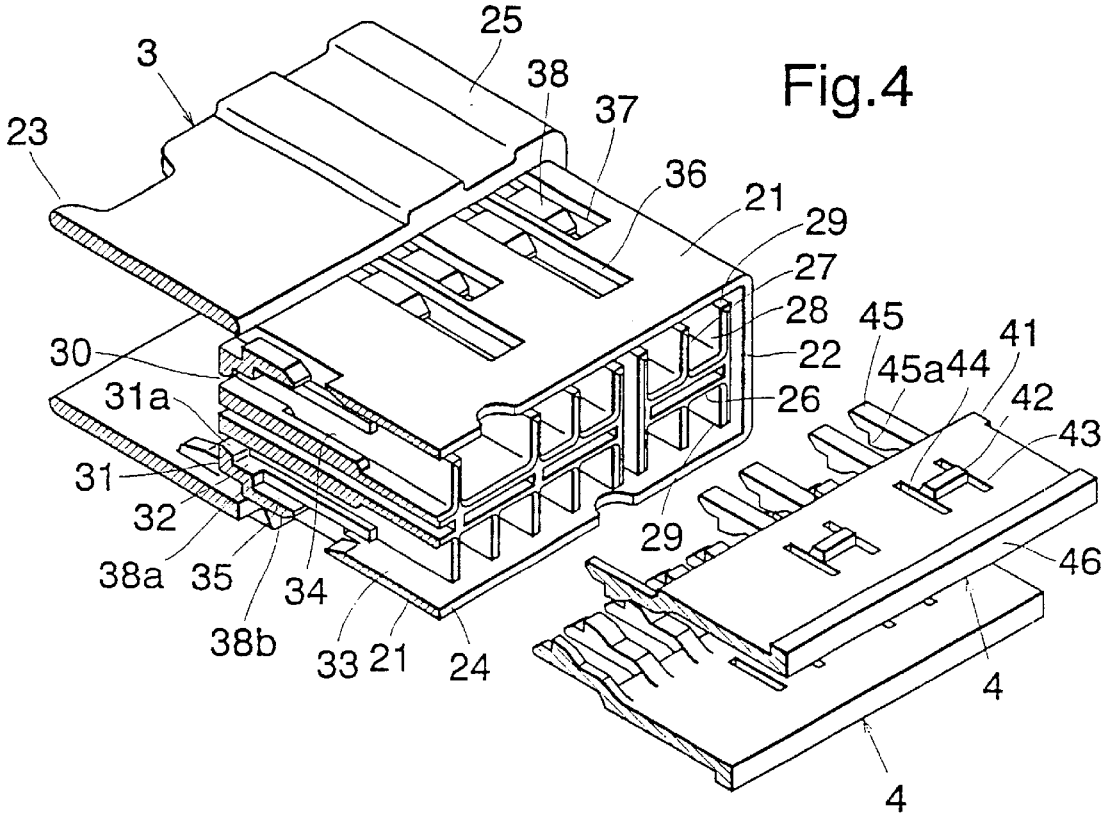
FIG. 4 is an exploded perspective view of the connector of FIG. 3, while connecting terminals are removed.
Figure 5:
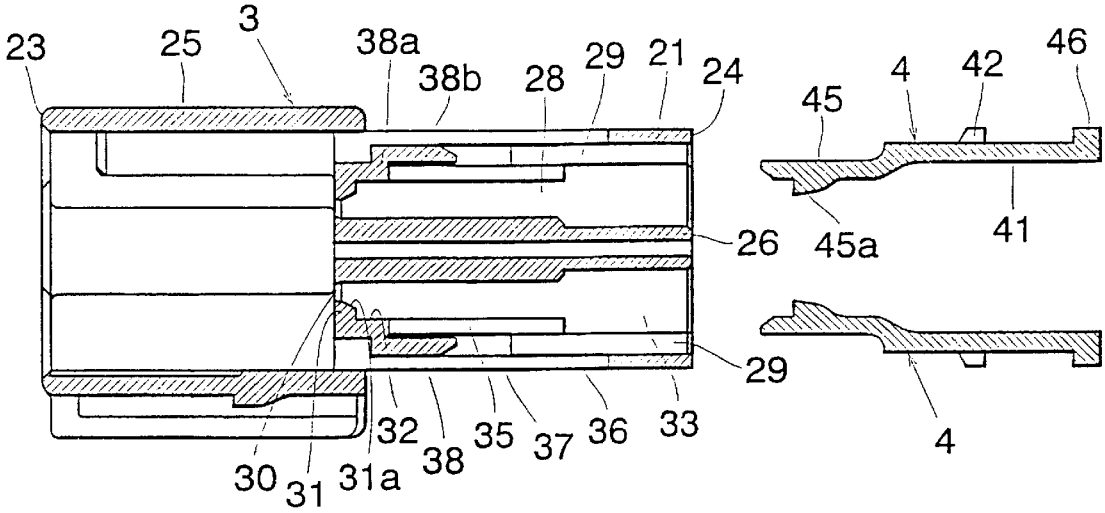
FIG. 5 is a longitudinal cross sectional view of the electrical connector shown in FIG. 4.

FIG. 3 is a perspective view showing a first embodiment of the electrical connector according to the invention in an assembled form. Male type connecting terminals 2 having electric conductors 1 connected to rear portions thereof are accommodated within a housing 3, and the connecting terminals 2 are locked by a rear holder 4 which is engaged with a rear portion of the housing 3. FIG. 4 is an exploded perspective view of the electrical connector from which the connecting terminals 2 are removed, and FIG. 5 is an exploded perspective view corresponding to FIG. 2.

The connecting terminal 2 is formed from a single electrically conductive metal plate and includes a terminal main body 11 formed in a shape of a rectangular hollow member and a terminal connecting portion 12 provided at a front end of the terminal main body, said terminal connecting portion 12 being formed in a flat blade which can be connected to a female type connecting terminal of a corresponding electrical connector not shown. At a rear portion of the terminal main body 11, there are further provided a core conductor clamping portion 13 for clamping a core conductor of the electric wire 1 and a sheath clamping portion 14 for clamping a sheath of the electric wire 1. The terminal main body 11 further includes a stabilizer 15 for keeping a stable posture of the connecting terminal 2 and a locking hole 16 which is engaged with an engaging portion of a locking arm of the rear holder as will be explained later.

The housing 3 is made of an electrically insulating synthetic resin material and accommodates a plurality of connecting terminals 2 aligned in upper and lower rows. The housing 3 includes upper and lower outer walls 21, right and left side walls 22, a front end surface 23 and a rear end surface 24. At the frond end surface 23, there is provided a tubular portion 25 into which a housing of a corresponding electrical connector is to be inserted. A space within the housing 3 is divided by a horizontal partition 26 and a plurality of vertical partitions 27 to form a plurality of terminal accommodating portions 28 for accommodating the connecting terminals 2. On inner surfaces of the upper and lower walls 21, there are formed slits 28 such that these slits are communicated with the terminal accommodating holes 28 through the vertical partitions 27 and the rear holder 4 can be inserted into the housing 3 through said slits 28.

At the front portion of the terminal accommodating holes 28 there is formed an end wall 31 having openings 30 through which the terminal connecting portions 12 of the connecting terminals 2 can project. In an inner surface of the opening 30, there is formed a guide surface 31a for guiding the terminal connecting portion 12 toward the opening 30. The terminal accommodating hole 28 includes a main body accommodating portion 32 for accommodating the terminal main body 11 of the connecting terminal 2 in a tight manner, a clamping portion accommodating portion 33 for accommodating the sheath clamping portion 14 of the connecting terminal 2, stabilizer guiding recesses 34 for guiding the stabilizers 15 of the connecting terminal 2, and an arm accommodating portion 35 for accommodating a locking arm of the rear holder 4.

In the upper and lower outer walls 21 there are formed locking holes 36 which are engaged with locking projections formed in the rear holder 4 as will be explained later, and windows 37 through which the terminal accommodating holes 28 are communicated with the external. Some locking holes 36 and windows 37 are communicated with each other by removing parts of the partitions. A tool for releasing a locking condition between a locking arm and a connecting terminal 2 as well as probes of an electrical conduction testing device can be inserted through the windows 37. On a side of the front end surface 23, a part of a window 37 constitutes an outer wall of the arm accommodating portion 35 and a stopper wall 38 for restricting the movement of the locking arm is provided. A vertical portion 38*a* and a horizontal portion 38*b* of a stopper wall 38 are urged against a front surface and a outer surface of a locking arm, respectively which is not resiliently bent. The horizontal portion 38*b* is urged against the front surface of a locking arm which is resiliently bent.

The rear holder 4 is manufactured in a substantially plate-like shape by means of an injection molding machine having a double-plate mold using an electrically insulating synthetic resin material. The rear holder 4 comprises a holder main body 41 which is inserted into the slits 29 of the housing 3 without play. On an outer surface of the holder main body 41 there are formed a plurality of locking projections 42 which are urged against the rear end surface 24 of the housing 3 and are engaged with the locking holes 36. On right and left sides of a locking projection 42 there are formed slits 43 and 44 which extend in a back and forth direction such that a portion of the holder main body 41 situating between these slits can be bent resiliently. At a front end of the holder main body 41 there are formed a plurality of resilient locking arms 45 for locking the connecting terminals 2 in position, each of said locking arms being inserted into respective terminal accommodating holes 28 of the housing 3. A locking arm 45 has a width which is slightly smaller than that of the terminal accommodating hole 28, and includes a locking portion 45*a* which is engaged with a locking hole 16 formed in a connecting terminal 2. On an outer surface of the rear end of the holder main body 41, there is provided a flange 46 which serves to limit the forward movement of the rear holder 4 by engagement with the rear end surface 24 of the housing 3.

Figure 6:
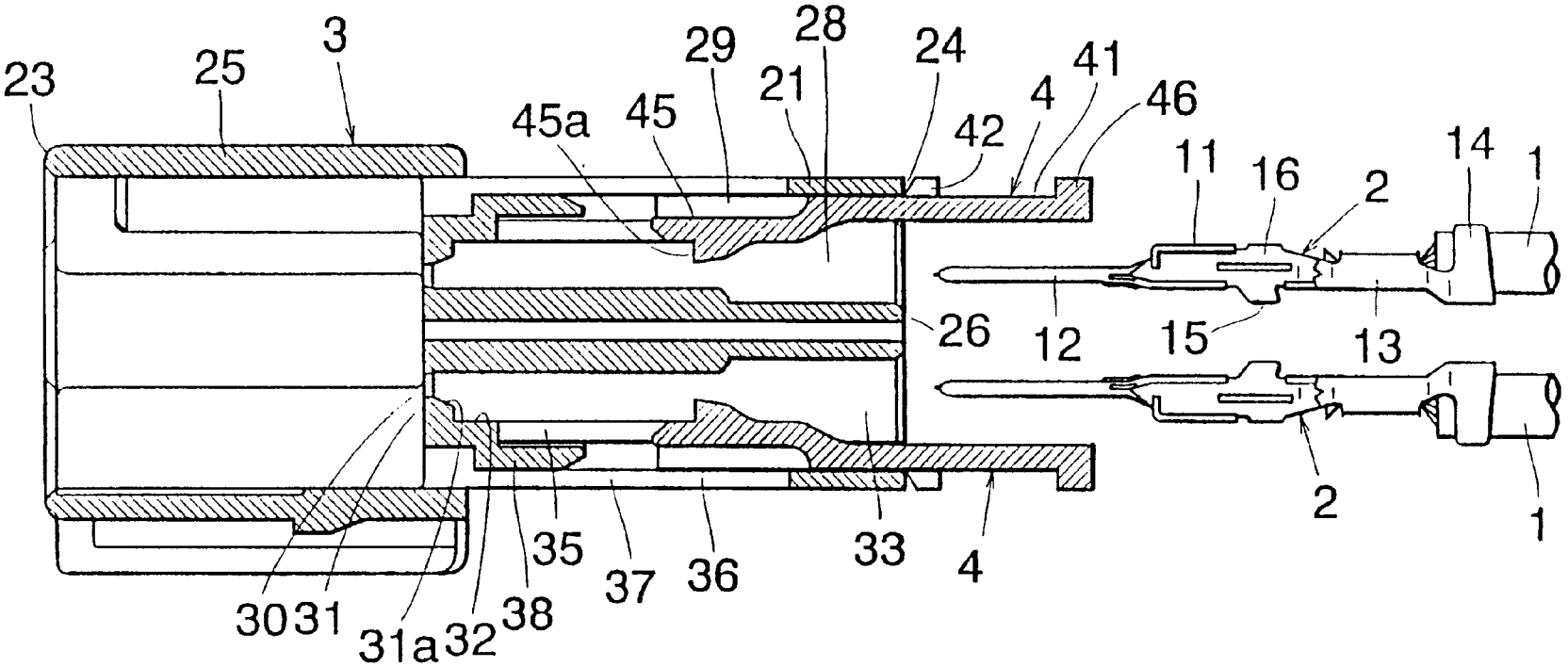
FIG. 6 is a longitudinal cross sectional view showing a condition in which a rear holder is locked at a provisional locking position.

FIGS. 6–17 show configurations, positions and operations of various portions of the connecting terminals 2, housing 3 and rear holder 4. FIG. 6 illustrates a provisional locking position in which the rear holder 4 has been inserted midway into the housing 3. In this condition, connecting terminals 2 are inserted into the housing 3 one by one. The locking projections 42 of the rear holder 4 are urged against the rear end surface 24 of the housing 3, and the locking portions 45*a* of the locking arms 45 of the rear holder 4 are situated at a substantially mid position of the terminal accommodating holes 28 viewed in the back and forth direction.

Figure 7:
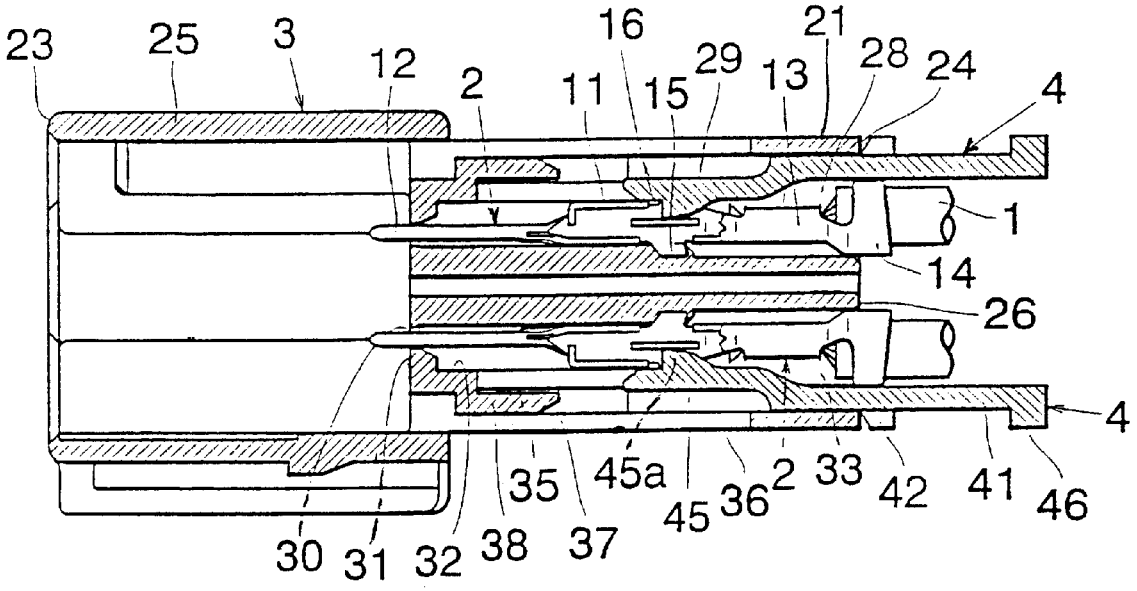
FIG. 7 is a longitudinal cross sectional view illustrating a condition in which connecting terminals have been inserted into the housing.

When a connecting terminal 2 is further inserted into a terminal accommodating hole 28, a locking portion 45*a* of a locking arm 45 is pushed outwardly by means of a terminal main body 11 of the inserted connecting terminal 2. In this manner, the connecting terminal 2 is moved forwardly while the locking arm 45 is resiliently bent outwardly. When the locking hole 16 of the connecting terminal 2 has passed through the locking portion 45*a* of the locking arm 45, the locking arm 45 is returned into their initial posture and the locking portion 45*a* is engaged with the locking hole 16 as depicted in FIG. 7.

Figure 8:
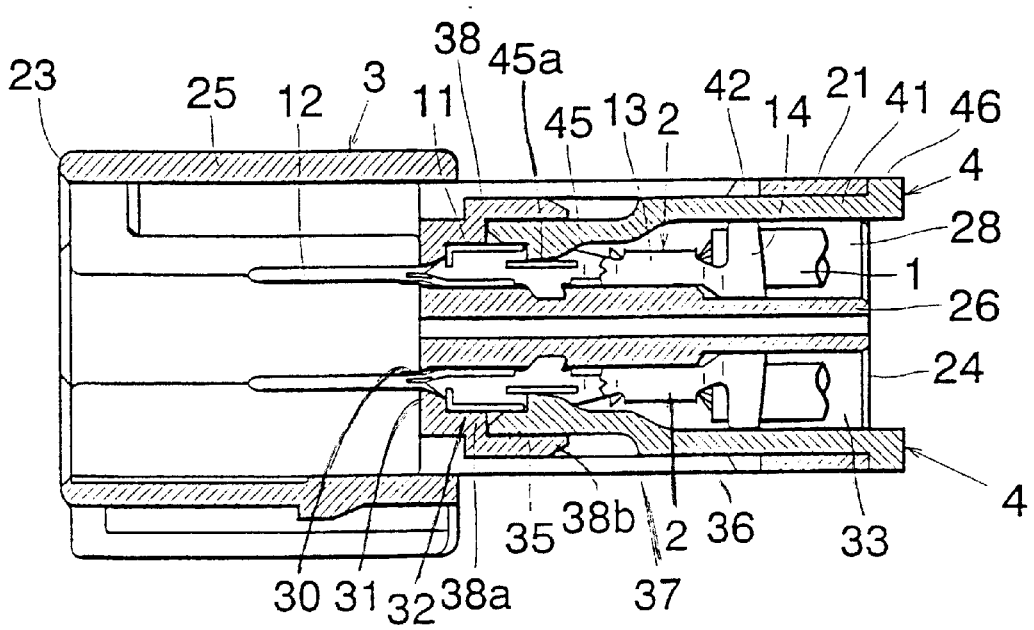
FIG. 8 is a longitudinal cross sectional view showing a condition in which the rear holder is pushed into a complete locking position.

After inserting all the necessary connecting terminals 2, the rear holder 4 is further inserted forwardly. During this operation, the locking projections 42 of the rear holder 4 are inserted into the slits 29 of the housing 3 while the portions between the slits 43 and 44 are deformed inwardly. By this operation, the rear holder 4 is moved into the complete locking position together with the connecting terminals 2, and the terminal main bodies 11 of the connecting terminals 2 are inserted into the main body accommodating portion 32 of the housing 3 and are urged against the end wall 31 as illustrated in FIG. 8. Furthermore, the locking arms 45 are inserted into the arm accommodating portion 35 and the front ends of the locking arms 45 are urged against the vertical portion 38*a* of the stopper wall 38. At the same time, the locking projections 42 are engaged with the locking holes 36 and the flange 46 is brought into contact with the rear end surface 24. In this case, the outer surfaces of the locking arms 45 are pushed by the horizontal portions 38*b* of the stopping wall 38 such that the locking force of the locking arms 45 for the connecting terminals 2 can be improved.

Figure 9:
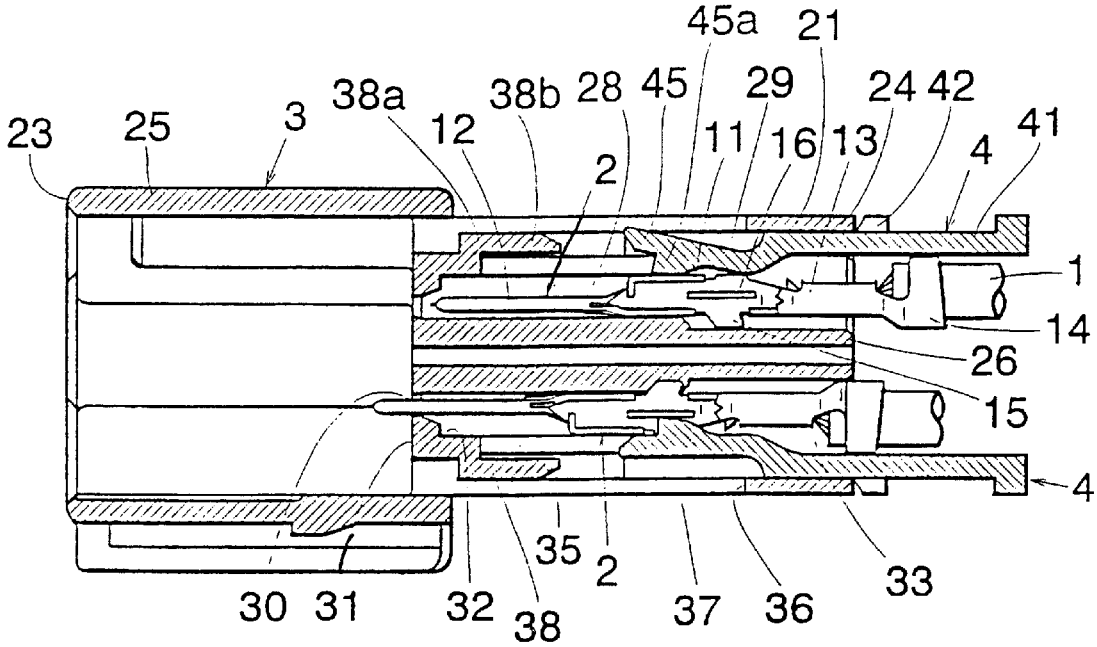
FIG. 9 is a schematic view illustrating a condition in which a connecting terminal is inserted halfway.
Figure 10:
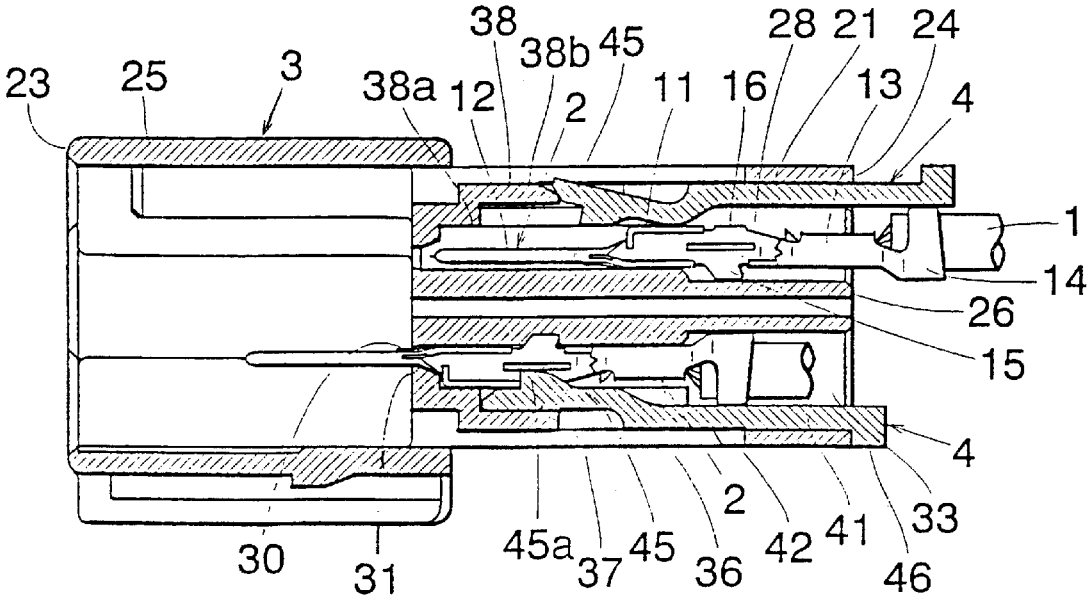
FIG. 10 is an explanatory view depicting a condition in which the rear holder is further inserted from the condition shown in FIG. 9.

When the rear holder 4 is situated at the provisional locking position with respect to the housing 4 and the connecting terminals 2 are inserted halfway, the locking arms 45 that remained to be resiliently bent outwardly by the terminal main bodies 11 of the connecting terminals 2 as depicted in an upper portion of FIG. 9. When the rear holder 4 is further inserted into the housing toward the complete locking position, the front ends of the locking arms 45 are urged against the horizontal portions 38*b* of the stopper wall 38 as shown in an upper portion of FIG. 10, and the rear holder 4 could not be moved further in the forward direction. By this condition, an operator can recognize that the in a way I and no when it at a connecting terminals 2 have not been inserted correctly. It should be noted that lower portions of FIGS. 9 and 10, show conditions in which the connecting terminals 2 has been correctly accommodated in the housing 3.

Figure 11:
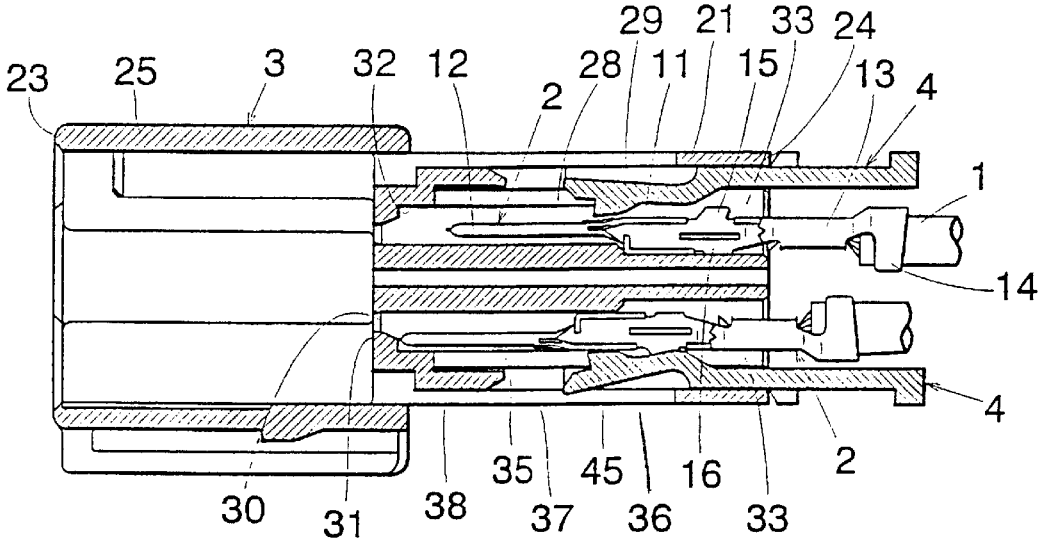
FIG. 11 is an explanatory view illustrating a condition in which the connecting terminals are inserted up side down.
Figure 12:
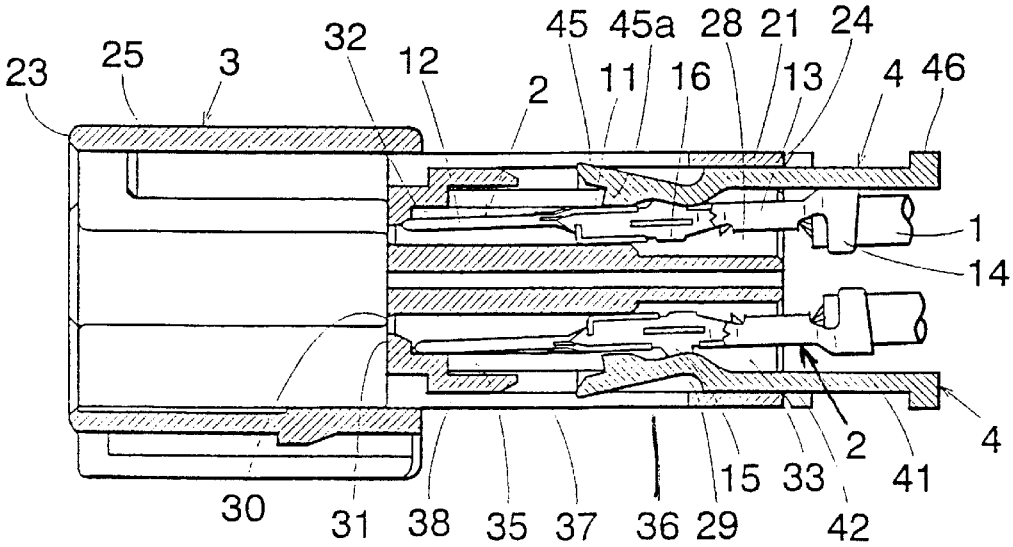
FIG. 12 is an explanatory view illustrating a condition in which the connecting terminals are inserted up side down.

If one or more connecting terminals 2 are inserted up side down, the terminal main bodies 11 of the connecting terminals 2 are urged against the front walls of the clamping portion accommodating portions 33 of the terminal accommodating holes 28, and the connecting terminals 2 could not be inserted into the given positions as illustrated in an upper portion of FIG. 11. If the connecting terminals 2 are further inserted, the connecting terminals 2 are advanced without being engaged with the locking arms 45 and the front ends of the terminal connecting portions 12 are urged against the end wall 31 of the housing 3 as shown in a lower portion of FIG. 11. Alternatively, as depicted in FIG. 12, the front ends of the terminal connecting 12 are urged against the end wall 31 and the sheath clamping portions 14 of the connecting terminals 2 are urged against the inner surface of the holder main body 41 of the housing 4. Then, the operator can recognize that the connecting terminals 2 have been inserted up side down.

Figure 13:
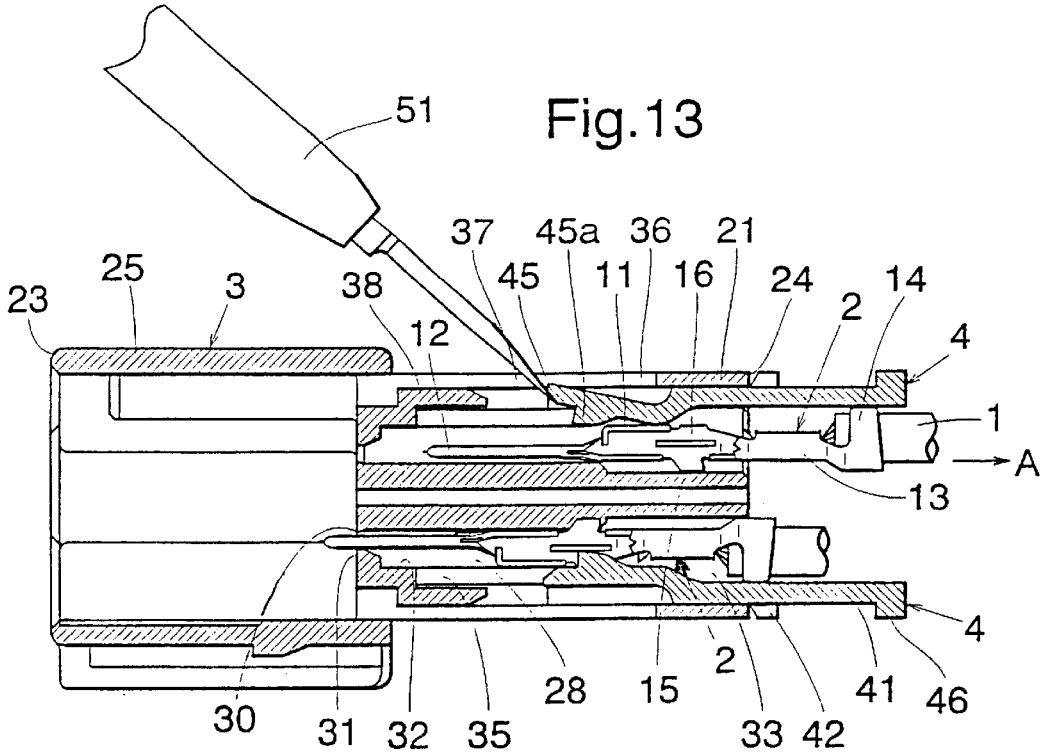
FIG. 13 is an explanatory view representing an operation for releasing a locked condition between the connecting terminal and the rear holder.

When the connecting terminals 2 which have been inserted correctly are to be removed from the housing 3, the rear holder 4 is moved backward from the complete locking position into the provisional locking position as shown in FIG. 13. Then, a tip of a tool 51 is inserted through a window 37 under a front end of a locking arm 45 and the locking arm is resiliently bent outwardly to release locking between the connecting terminal 2 and the locking arm 45, and a electrical wire 1 is pulled in a direction A.

Figure 14:
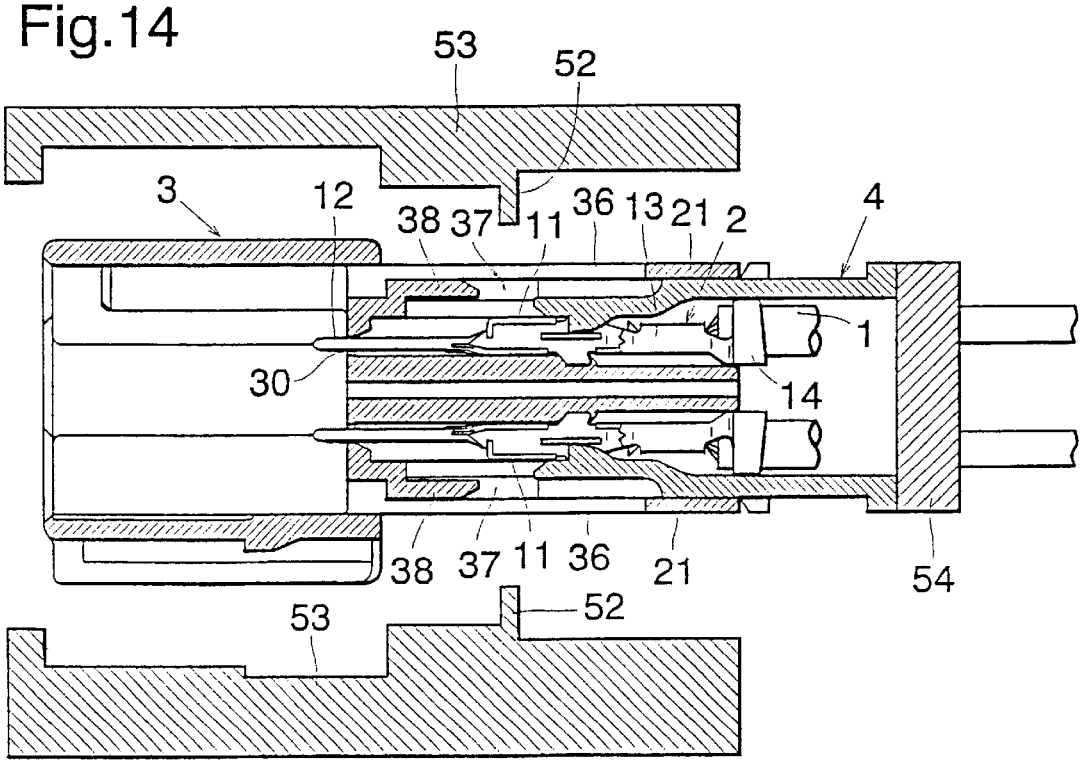
FIG. 14 is a schematic view showing an electrical conduction test.

When the electrical conduction test for preventing erroneous wiring of the electrical wires 1 is to be performed, the connecting terminals 2 are inserted into the housing 3 at the provisional locking position of the rear holder 4 and conduction test tools 53 having probes 52 are situated in opposition to the upper and lower outer walls 21 as depicted in FIG. 14. Since a plurality of connecting terminals 2 are aligned in a direction perpendicular to a plane of the drawing, a plurality of corresponding probes 52 are also aligned in the same direction. The upper and lower conduction test tools 53 are coupled with each other into a single unit by means of an electrically insulating member not shown and are arranged to be opened and closed.

Figure 15:
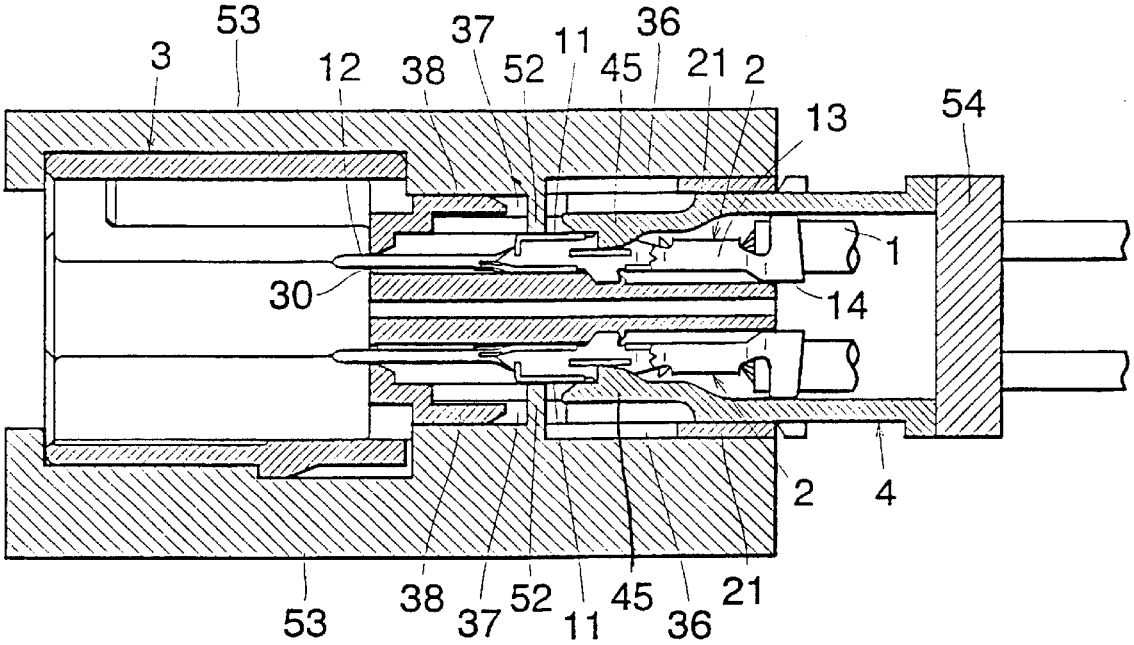
FIG. 15 is a view depicting the electrical conduction test.

When the conduction test tools 53 are closed to clamp the housing 3 therebetween as depicted in FIG. 15, the probes 52 are brought into contact with the terminal main bodies 11 of the connecting terminals 2 through the windows 37. In this manner, the electrical conduction test can be performed. That is to say, the wire harness circuit can be tested by means of a test circuit connected to the conduction testing tools 53.

Figure 16:
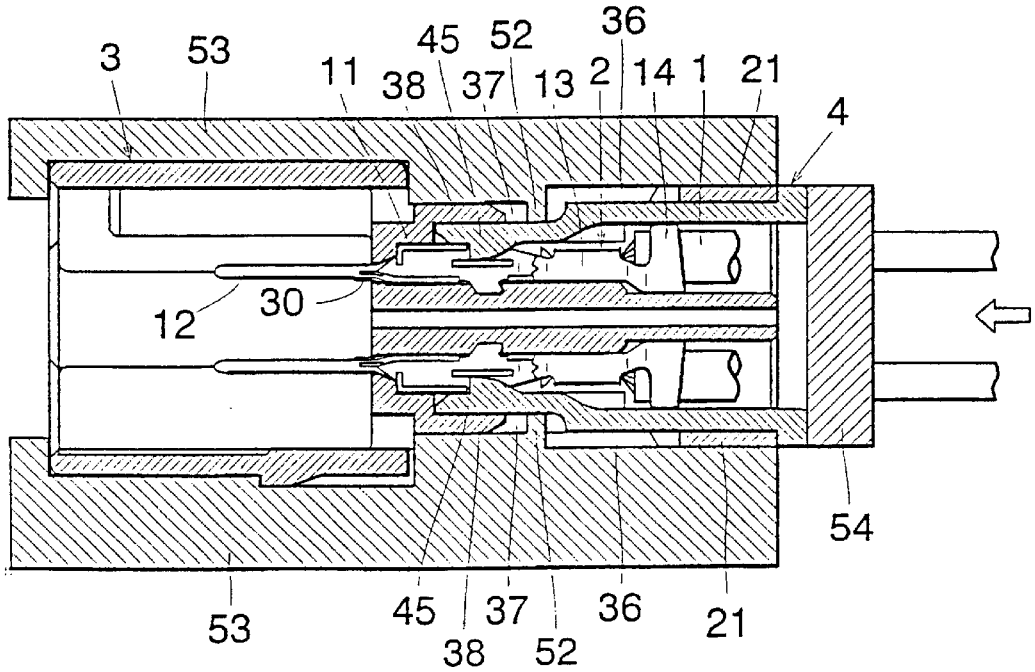
FIG. 16 is a view showing a step after the electrical conduction test.
Figure 17:
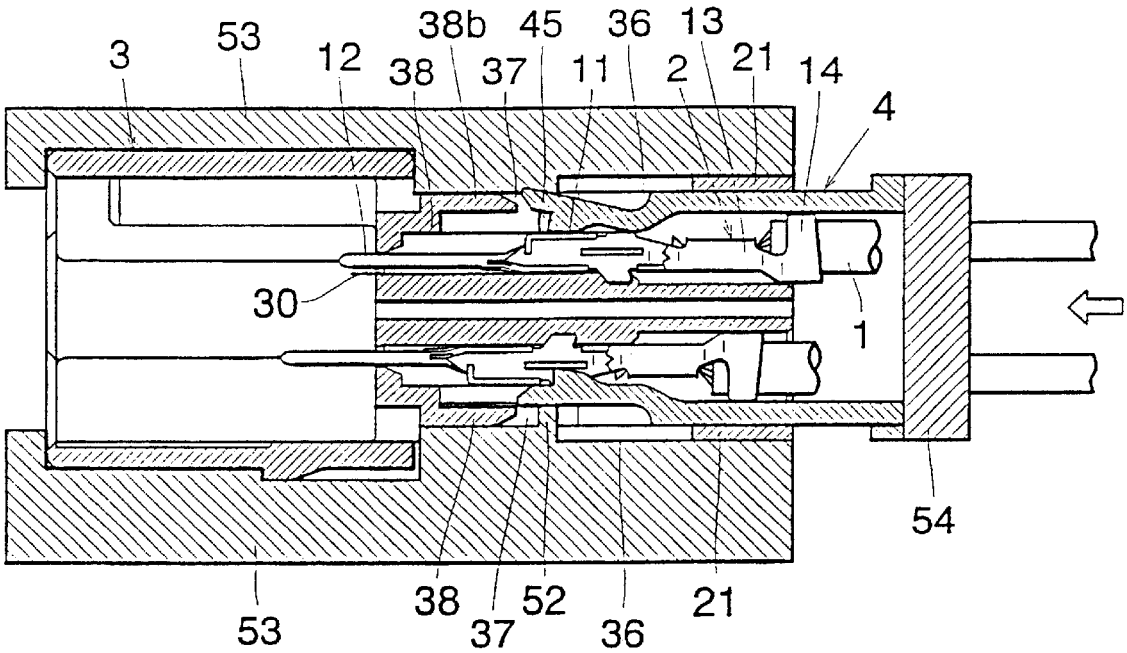
FIG. 17 is a view for explaining the electrical conduction test wherein a locking arm is not in a locked condition.
Figure 18:
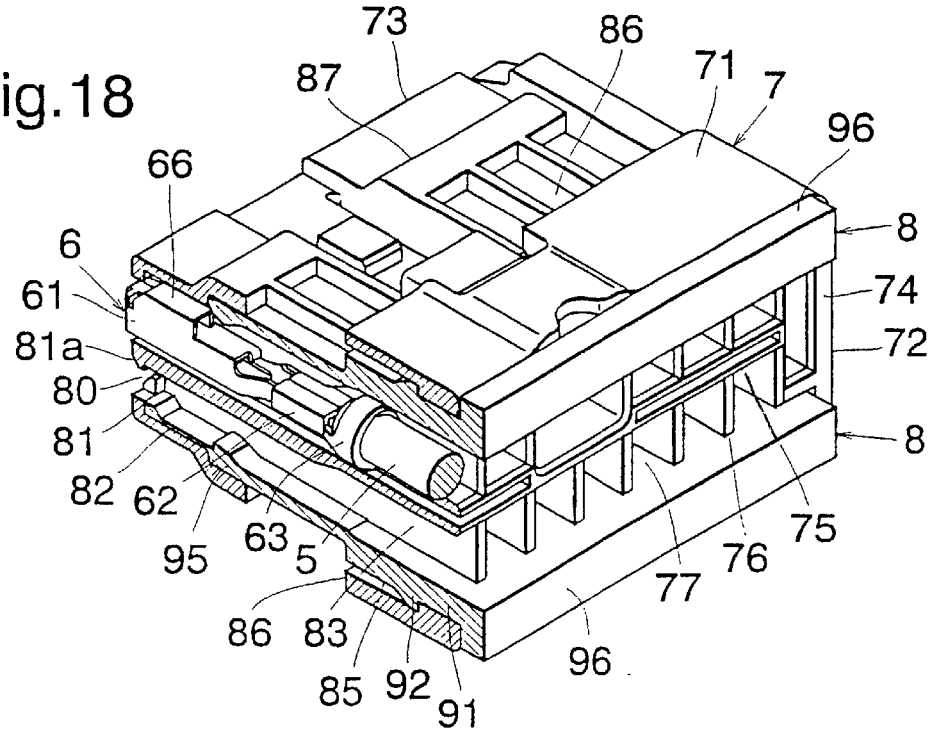
FIG. 18 is a perspective view showing a second embodiment of the electric connector according to the invention in an assembled condition.

After the electrical conduction test, as shown in FIG. 16, the rear holder 4 is pushed by means of a pushing tool 54 with a given force such as about 1 kgf. In this case, when the connecting terminals 2 and locking arms 45 are not correctly engaged with each other as illustrated in FIG. 17, the locking arms 45 are remained in a outwardly bent condition, but a normal result of the electrical conduction test is obtained. However, the rear holder 4 could not be inserted into the complete locking position owing to the engagement of the front ends of the locking arms 45 with horizontal portions 38*a* of the stopper wall 38 when the rear holder 4 is pushed forward, and the operator can recognize the condition that the connecting terminals 2 have not been inserted correctly.

Figure 19:
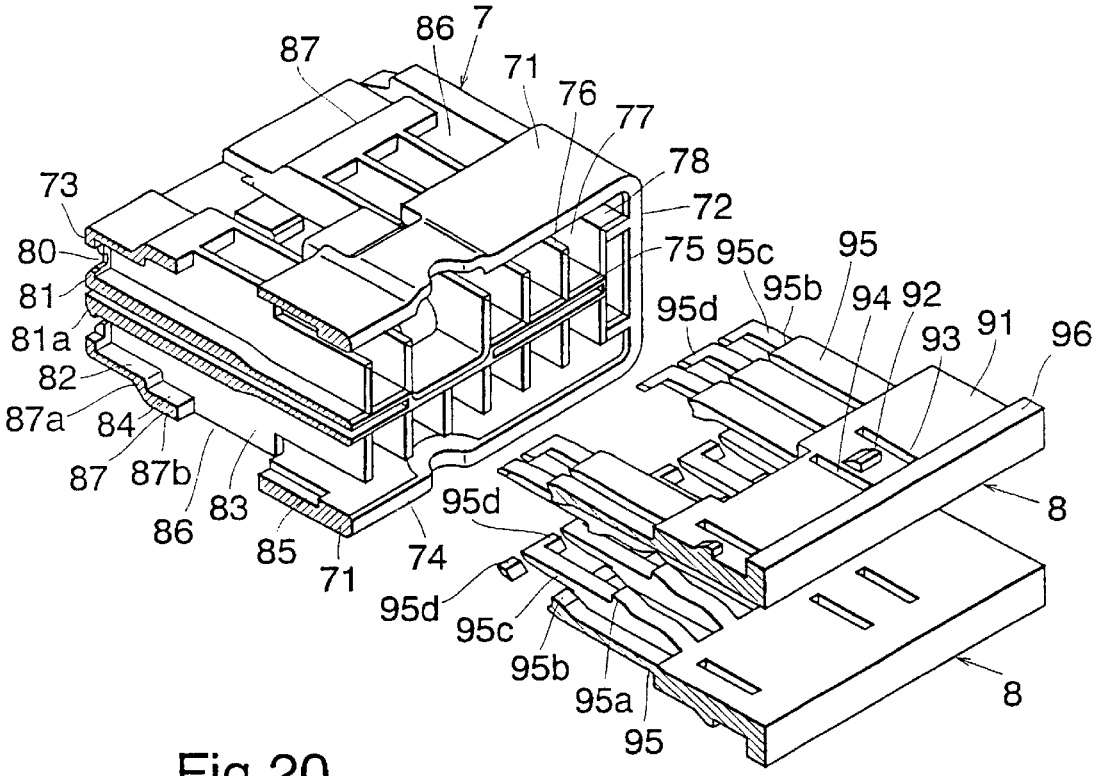
FIG. 19 is an exploded perspective view of the electrical connector shown in FIG. 18 while connecting terminals have been removed.
Figure 20:
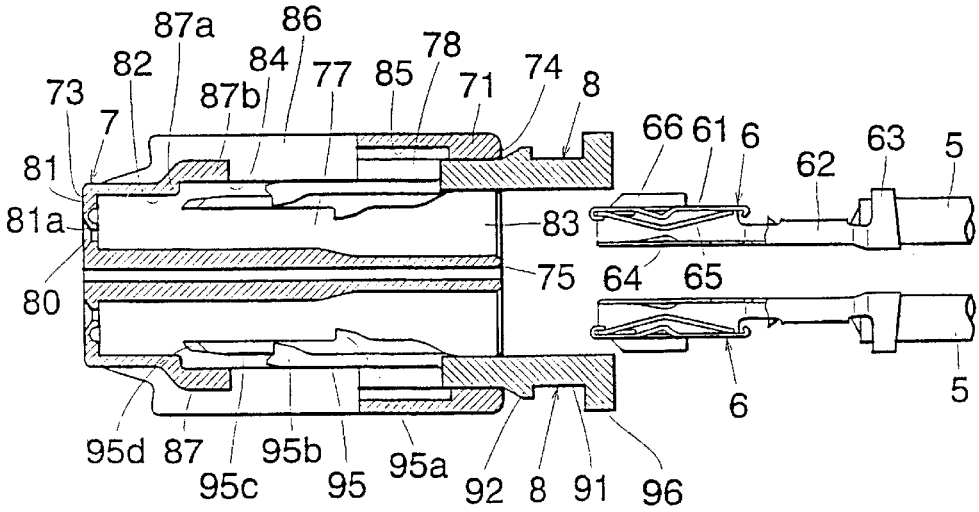
FIG. 20 is an exploded perspective view depicting a condition in which a rear holder locked at a provisional locking position.

FIG. 19 is a perspective view showing a second embodiment of the electrical connector according to the invention in an assembled condition, while parts of the connector are cut off. In this embodiment, female type connecting terminals 6 having electric wires 5 connected to their rear ends are accommodated within a housing 7 and are locked in position by means of a rear holder 8 engaged with the rear portion of the housing 7. FIG. 19 is an exploded perspective view showing the connector while the connecting terminals 6 are removed, and FIG. 20 is an exploded perspective of the connector with the connecting terminals 6. At a rear portion of a rectangular hollow terminal main body 61 of a connecting terminal 6 there are provided a core wire clamping portion 62 and a sheath clamping portion 63. Within the terminal main body 61 there are provided a fixed contacting member 64 which can be urged against a male type connecting terminal of a corresponding connector not shown, and a movable contact 65. On an outer surface of the terminal main body 61, there is formed a stabilizer 66 which is locked by the rear holder 8. The housing 7 comprises upper and lower outer walls 71, right and left side walls 72, a front end surface 73 and a rear end surface 74, and a space within the housing 3 is divided by a horizontal partition 75 and vertical partitions 76 to form a plurality of terminal accommodating portions 77. On inner surfaces of the upper and lower walls 71, there are formed slits 78. At the front portion of the terminal accommodating holes 77 there is formed and end wall 81 having openings 80 and in an outer surface of the end wall 81, there is formed a guide surface 81*a*. The terminal accommodating hole 77 includes a main body accommodating portion 82 for accommodating the terminal main body 61 of the connecting terminal 6 as well as a part of a locking arm in a tight manner, a clamping portion accommodating portion 83 for accommodating the sheath clamping portion 63 of the connecting terminal 6, an arm accommodating portion 84 for accommodating the other portion of the locking arm, and a lock stopping recess 85 which is engaged with a lock stopping projection of the rear holder 8. In the upper and lower outer walls 71, there are formed windows 86 through which the terminal accommodating holes 77 are communicated with the external, and a stopper wall 87 is provided at front end surfaces 73 of the windows 86. The stopper wall 87 includes a vertical portion 87*a* and a horizontal portion 87*b* and constitutes an outer wall of the arm accommodating holes 84.

The rear holder 8 is formed in a substantially plate-like shape and comprises a holder main body 91, lock stopping projection 92 and slits 93, 94 formed in the outer surface of the holder main body 91, and a plurality of resilient locking projections 95 provided at a front end of the holder main body 91. A locking arm 95 has a width which is slightly smaller than that of the terminal accommodating hole 77 of the housing 7, and includes a first locking portion 95*a* which is engaged with a rear portion of a terminal main body 61 of a connecting terminal 6, a second locking portion 95*b* which locks a rear portion of a stabilizer 66 of the connecting terminal 6, and first and second holding portions 95*c* and 95*d* which hold a side portion and a front portion of the stabilizer 66, respectively, said portions being formed as an integral body. At a rear portion of the holder main body 91, there is formed a flange 96.

Figure 21:
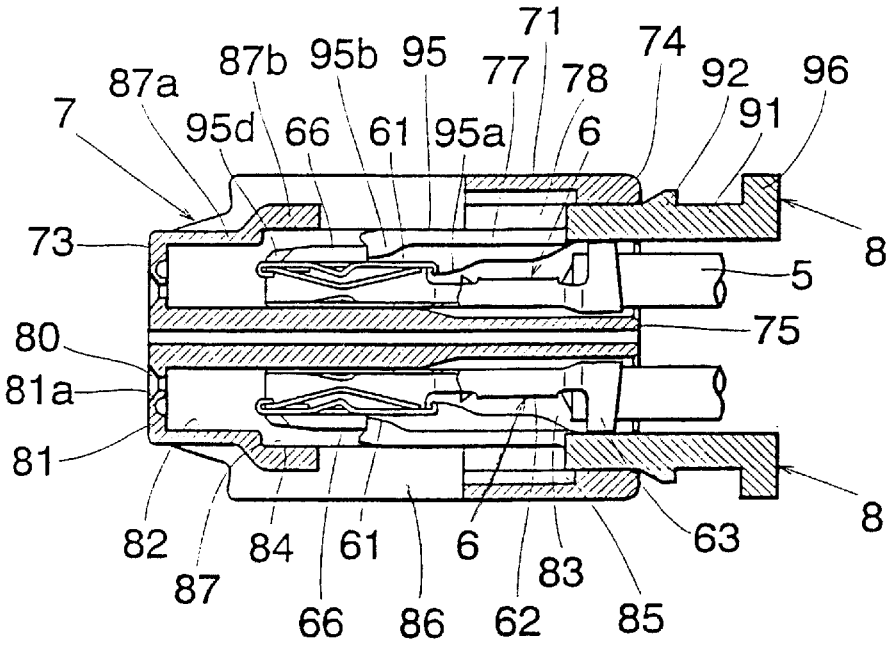
FIG. 21 is a longitudinal cross sectional view showing a condition in which the connecting terminals are inserted into the housing.

FIGS. 21–28 illustrate the functions of the second embodiment of the electrical connector according to the invention. In a provisional locking position of the rear holder 8, when a connecting terminal 6 is inserted into the housing 7, the terminal main body 61 of the connecting terminal 6 is moved forward while a locking arm 95 is resiliently bent outwardly. When the terminal main body 61 of the connecting terminal 6 has passed through the first locking portion 95*a* of the locking arm 95, the locking arm 95 is returned and the rear end of the terminal main body 61 is locked by the first locking portion 95*a* as shown in FIG. 21. At the same time, the rear end of the stabilizer 66 is locked by the second locking portion 95*b*, and first and second holding portions 95*c* and 95*d* push the side wall and front wall of the stabilizer 66, respectively.

Figure 22:
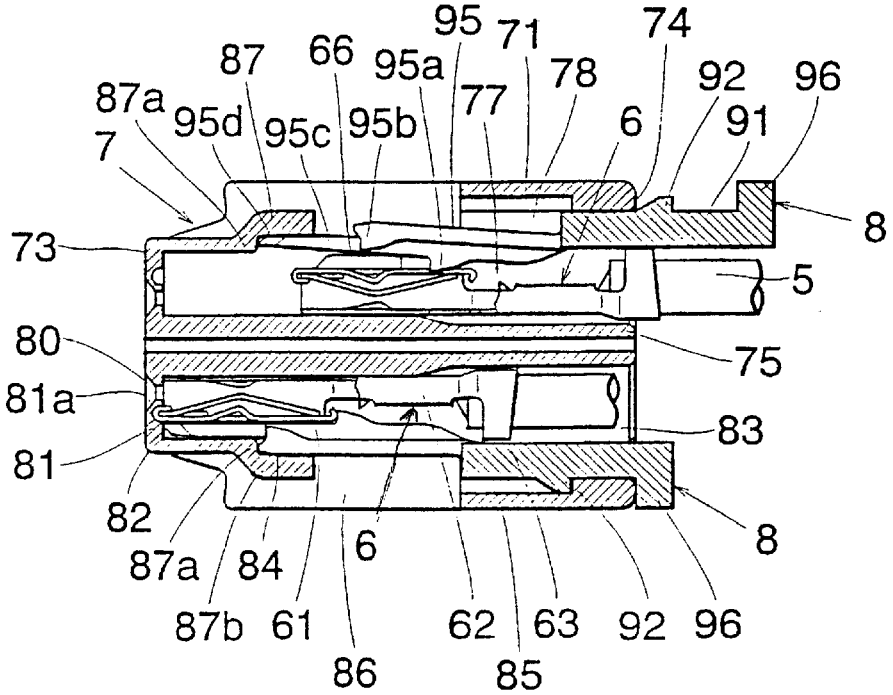
FIG. 22 is an explanatory view illustrating a condition in which the insertion of the connecting terminals has been interrupted.

When the rear holder 8 is further inserted forwardly into the complete locking position, as depicted in a lower portion of FIG. 22, the terminal main bodies 61 of the connecting terminals 6 are inserted into the main body accommodating portion 82 of the housing 7 and are urged against the end wall 81. Simultaneously, the first and second holding portions 95*c* and 95*d* of the locking arms 95 are inserted into the main body accommodating portion 82 and the second locking portion 95*b* is inserted into the arm accommodating portion 84 and are urged against the vertical portion 87*a* of the stopper wall 87. At the same time, the lock stopping projections 92 of the rear holder 8 are engaged with the lock stopping holes 85 of the housing 7 and the flange 96 of the rear holder 8 is brought into contact with the rear end surface 74 of the housing 7. In this condition, the outer surfaces of the second locking portions 95*b* of the locking arms 95 are pushed by the horizontal portions 87*b* of the stopper wall 87 of the housing, and this results in that the locking force for the connecting terminals 6 can be maintained sufficiently.

When the rear holder 8 is in the provisional locking position, if the connecting terminals 6 are inserted halfway, the locking arms 95 are resiliently bent outwardly by means of the stabilizers 66 as depicted in an upper portion of FIG. 22. Therefore, when the rear holder 8 is further inserted toward the complete locking position, the second locking portions of the locking arms 95 are brought into contact with the horizontal portions 87*b* of the stopper wall 87. Therefore, the rear holder 8 could not be moved further in the forward direction and an operator can recognize that the connecting terminals 6 have not been inserted correctly in the provisional locking position.

Figure 23:
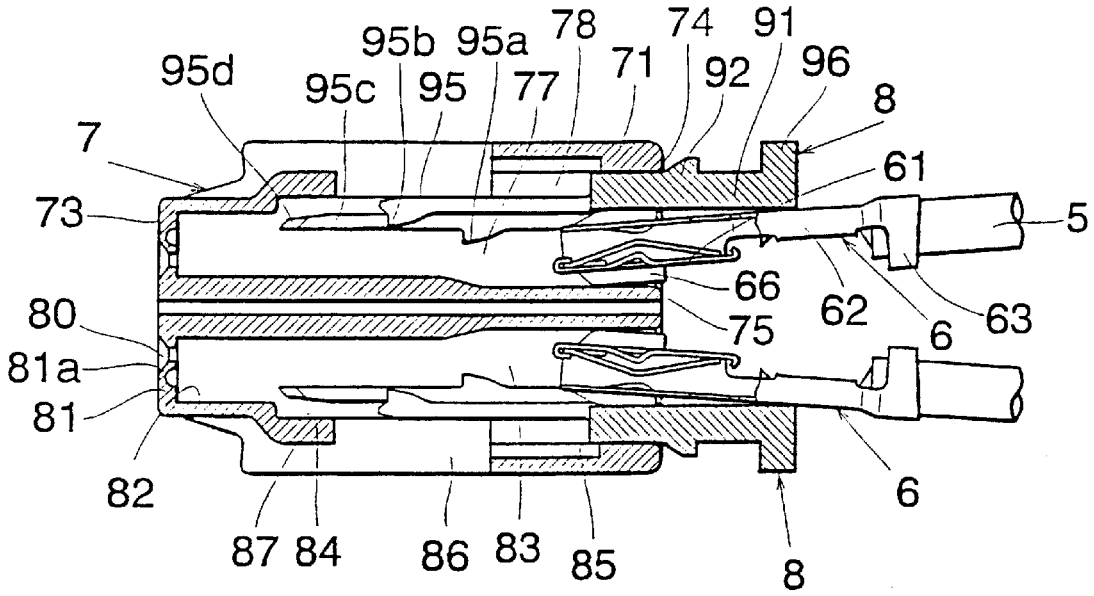
FIG. 23 is an explanatory view depicting a condition in which the connecting terminals are inserted up side down.

If one or more connecting terminals 6 are inserted up side down as shown in FIG. 23, the terminal main bodies 61 of the connecting terminals 6 are urged against the rear portions of the locking arms 95 of the rear holder 8 and the stabilizers 66 of the connecting terminals 6 are brought into contact with the partition 75 of the housing 7. Furthermore, the core wire accommodating portions 62 of the connecting terminals 6 are brought into contact with the holder main body 91 of the rear holder 9, and therefore, the connecting terminals 6 could not be inserted any more.

Figure 24:
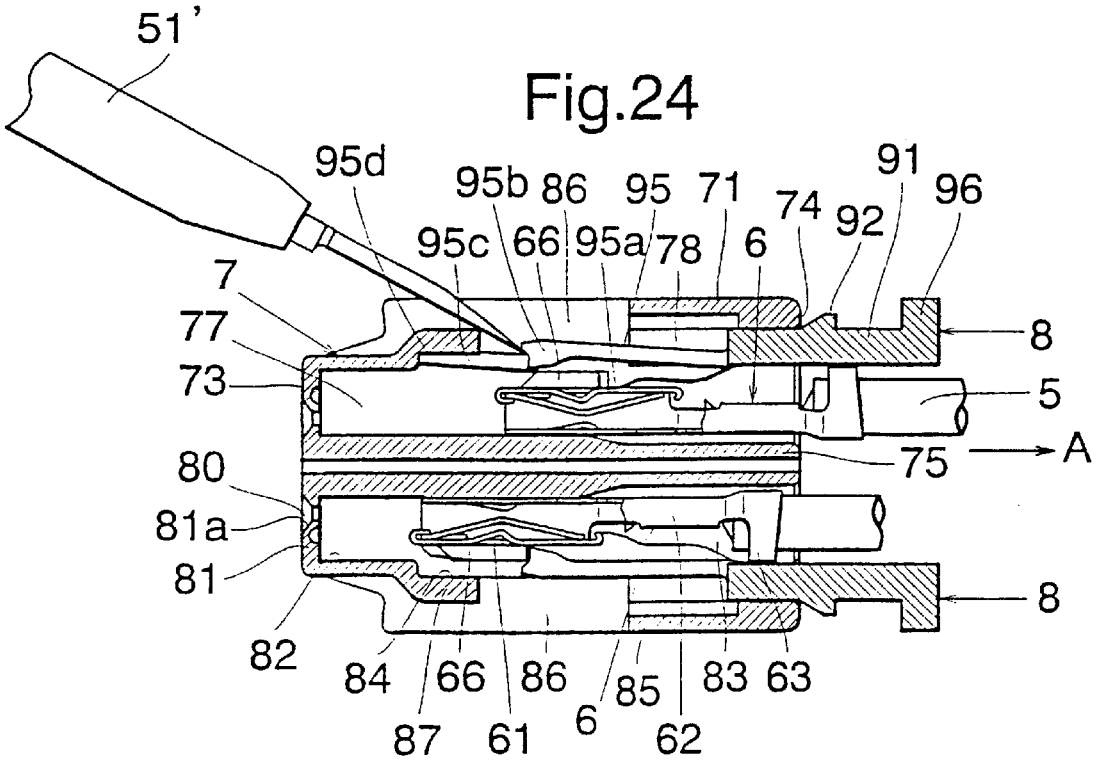
FIG. 24 is an explanatory view for releasing a locked condition between the connecting terminal and the rear holder.

When the connecting terminals 6 which have been inserted correctly are to be removed from the housing 7, at first the rear holder 8 is pulled out of the complete locking position and is moved into the provisional locking position as shown in FIG. 24. Then, a tip of a tool 51' is inserted through a window 86 of the housing 7 under a front end of a second locking portion 95*b* and the locking arm 95 is resiliently bent outwardly to release locking between the connecting terminal 6 and the locking arm 95, and an electrical wire 5 is pulled in a direction A.

Figure 25:
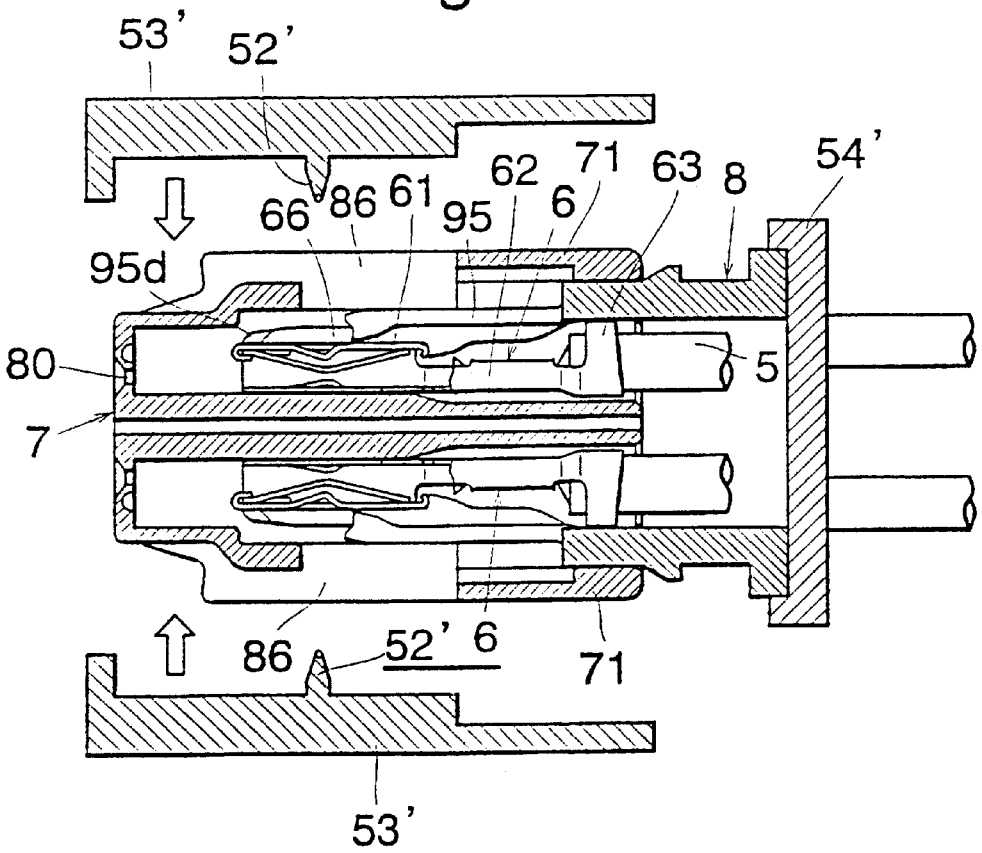
FIG. 25 is a view illustrating the electrical conduction test.
Figure 26:
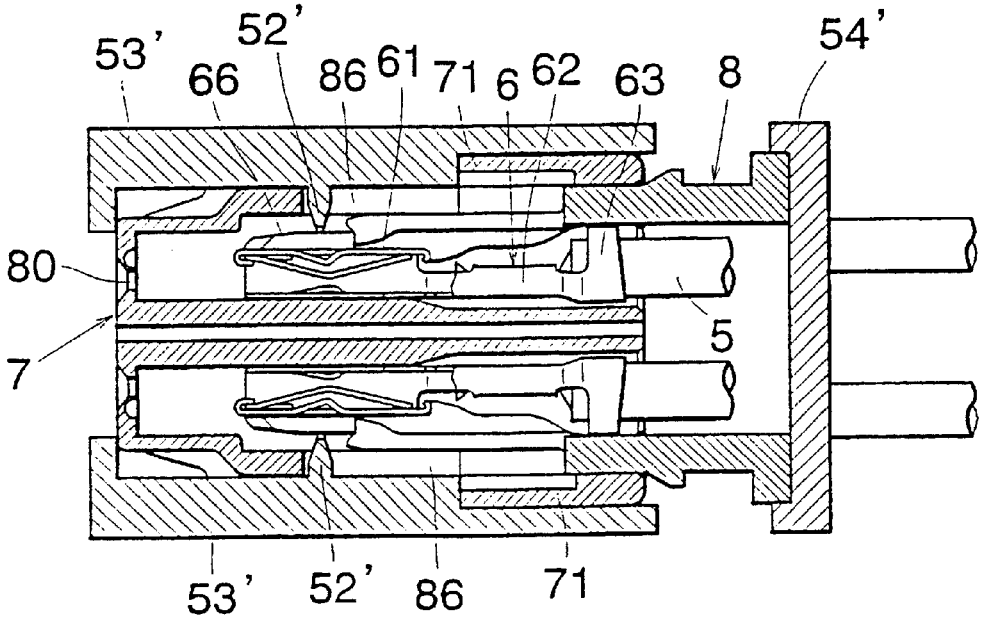
FIG. 26 is a view depicting the electrical conduction test.

When the electrical conduction test for preventing erroneous wiring of the electrical wires 5 is to be performed, as illustrated in FIG. 25, the connecting terminals 6 are inserted into the housing 7 at the provisional locking position of the rear holder 8 and conduction test tools 53' having probes 52' are situated in opposition to the upper and lower outer walls 71 of the housing 7. Next, the upper and lower conduction test tools 53' are coupled with the housing 7 as depicted in FIG. 26 such that the probes 52' are brought into contact with the stabilizers 66 of the connecting terminals 6 through the windows 86 of the housing 8. In this manner, the electrical conduction test can be carried out.

Figure 27:
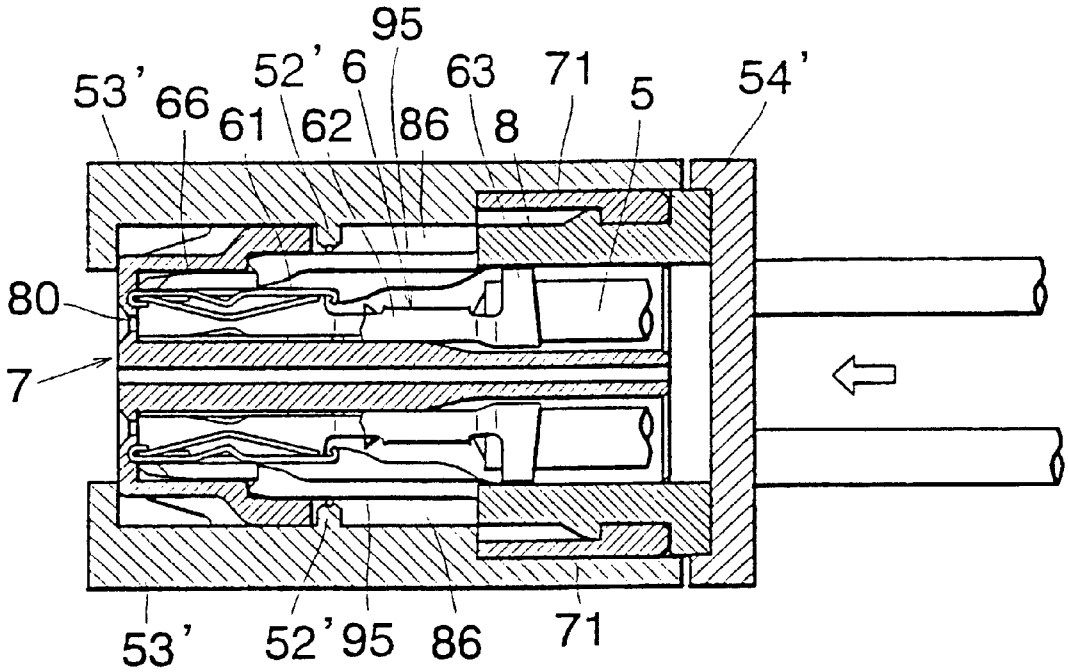
FIG. 27 is a view showing a step after the electrical conduction test.
Figure 28:
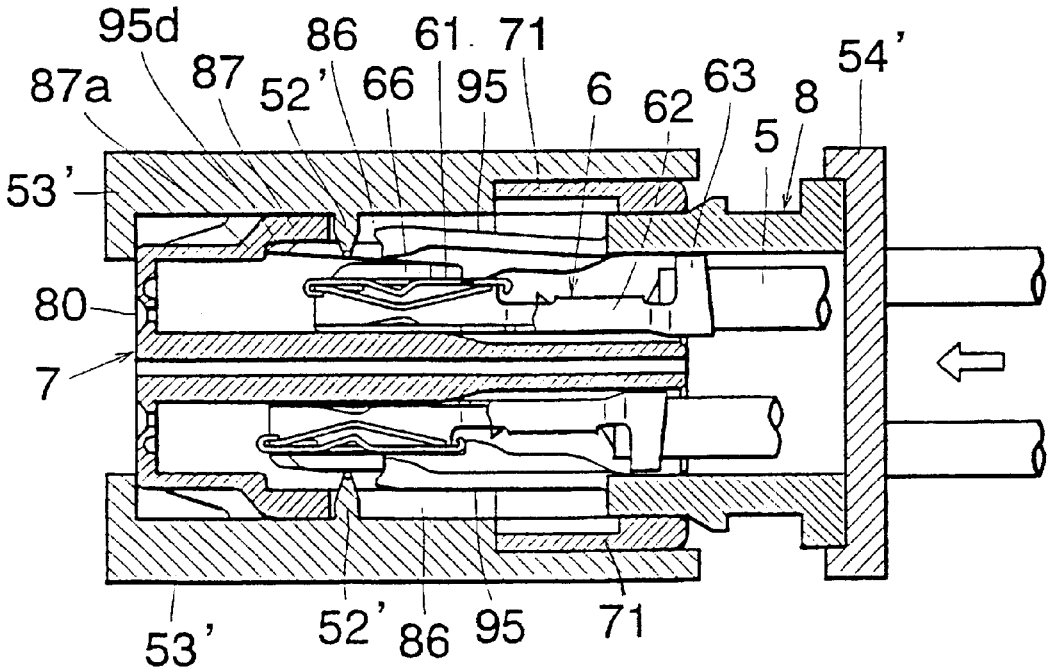
FIG. 28 is an explanatory view showing the electrical conduction test under a condition in which the locking arm is not in the locked condition.

After the electrical conduction test, as shown in FIG. 27, the rear holder 8 is pushed by means of a pushing tool 54' with a force like as the first embodiment. Also in the second embodiment, when the connecting terminals 6 and locking arms 95 are not correctly engaged with each other as illustrated in FIG. 28, the locking arms 45 are remained in a outwardly bent condition, but the electrical conduction test shows a normal result. However, since the second holding portions 95*d* of the locking arms 95 are brought into contact with the vertical portions 87*a* of the stopper wall 87 when the rear holder 4 is pushed forward, the rear holder 8 could not be inserted into the complete locking position. In this manner, the operator can recognize the condition that the connecting terminals 6 have not been inserted correctly.

As stated above, in the first and second embodiments, since the rear holder 4, 8 is formed as a substantially flat plate, it can be manufactured by means of a simple mold of a double-plate structure. Therefore, a width of the locking arm 45, 95 can be close to that of the terminal accommodating hole 28, 77, a plurality of the locking portions 95*a*, 95*b* can be provided, and the first and second holding portions 95*c*, 95*d* can be provided. Furthermore, the locking arms 45, 95 can be held by the stopper wall 38, 87. In this manner, the locking force of the locking arms 45, 95 can be improved.

Moreover, since the housing 3, 7 does not include the locking arms, a mold for manufacturing the housing can be simple and a cost for manufacturing the housing 3, 7 can be reduced. The guide surfaces 31*a*, 81*a* can be provided in the end wall 31, 81 of the housing 3, 7, and therefore an operation of inserting the connecting terminals 2 and an operation of coupling a corresponding connector can be performed easily. Furthermore, since the connecting terminal 3, 6 can be inserted in a direction parallel to an axis of the housing 3, 7, an operation of inserting the connecting terminals 2, 6 becomes easy and undesired insertion of connecting terminals 2, 6 such as halfway insertion and up-side-down insertion can be effectively prevented. In this manner, a reliability of the electrical connection can be improved.

The locking condition between the connecting terminals 2, 6 and the rear holder 4, 8 can be released from the windows 37, 86 provided in the upper and lower outer walls 21, 71 of the housing 3, 7, and therefore the locking release operation can be performed without difficulty. Moreover, the connecting terminals 2, 6 can be removed from the housing 3, 7 by means of the tool 51, S1' without injuring the housing 3, 7 and connecting terminals 2, 6. Since the condition of the connecting terminals 2, 6 inserted into the housing 3, 7 can be monitored through the windows 37, 85, erroneous insertion of the connecting terminals 2, 6 can be prevented.

The probes 52, 52' of the electrical conduction test tool 53, 53' can be brought into contact with the connecting terminals 2, 6 through the windows 37, 86 formed in the outer walls 21, 71 of the housing 3, 7. In the known electrical connectors, the probes 52, 52' of the electrical conduction test tool must be connected to the connecting terminals 2, 6 by inserting them into the housing through the opening 30, 80 of the housing 3, 7 with a large force.

In the first and second embodiments of the electrical connector according to the invention, the connecting terminals 2, 6 are arranged in two rows, but according to the invention, they may be aligned in a single row. When the connecting terminals 2, 6 are arranged in more than two rows, windows are formed in the partition 26, 27 at positions corresponding to the windows 37, 86, and after removing the upper and lower connecting terminals 2, 6, the tool 51, 51' may be inserted through these windows and the locking between the connecting terminals 2, 6 and the locking arms 45, 95 may be released. Positions and size of the windows 37, 86 of the housing 3, 7 are set such that both the lock releasing tool 51, 51' and the electrical conduction tool 53, 53' can be inserted through the windows, but if it is not necessary to insert the lock releasing tool 51, 51', the windows may be small such that only the electrical conduction test tool 53, 53' can be inserted through the windows.

As explained above, in the electrical connector according to the invention, since the rear holder is formed in a substantially flat plate-shape, the rear holder can be manufactured by a simple double-plate mold and the locking arms can be formed easily. Since the locking arm has a width which is slightly smaller than that of a terminal accommodating hole, the locking arm can have a larger width than the known connector, and a locking force of the locking arm can be increased.

In the electrical connector according to the invention, since the windows are formed in the outer wall of the housing, the locking condition between the connecting terminal and the locking arm can be released by inserting the tool through the windows. Therefore, it is no more necessary to insert the tool from the front opening or rear opening of the housing, and thus the housing and connecting terminals can be prevented from being injured by the tool.

Furthermore, since the probes of the electrical conduction test tool can be brought into contact with the connecting terminals through the windows formed in the outer wall of the housing, it is no more necessary to insert the probes of the electrical conduction test tool from the front opening of the housing into which a corresponding connector is to be inserted, and the electrical conduction test can be performed easily.

What is claimed is:

1. An electrical connector including a housing having a plurality of terminal accommodating holes respectively receiving a connecting terminal, a rear holder which is inserted into a rear portion of the housing for pushing the connecting terminals into the terminal accommodating holes and holding the connecting terminals within the terminal accommodating holes, the rear holder including a single planar surface for receiving a plurality of the connecting terminals, the rear holder further having a plurality of locking arms arranged at a front end of the rear holder respectively corresponding to the connecting terminals, the rear holder having locking means for engaging in the housing at a provisional locking position and a final locking position, the rear holder introducing the connecting terminals received along the single planar surface of the rear holder to the terminal accommodating holes of the housing at the provisional locking position and locking the connecting terminals within the terminal accommodating holes at the final locking position.

2. The electric connector according to claim 1, wherein a width of the locking arms is slightly smaller than a width of the terminal accommodating holes.

3. The electric connector according to claim 1, wherein the locking arms respectively have a front end with a locking portion, the connecting terminals respectively have a middle portion, and the middle portion of the connecting terminal is respectively locked with the locking portion of the locking arm.

4. The electric connector according to claim 1, wherein the locking portion of the locking arm respectively faces the single planar surface of the rear holder.

* * * * *